United States Patent [19]

Dalbo

[11] Patent Number: 4,483,505

[45] Date of Patent: Nov. 20, 1984

[54] FOLDABLE STAND

[75] Inventor: Emil J. Dalbo, Atlanta, Ga.

[73] Assignee: Dal-Craft, Inc., Tucker, Ga.

[21] Appl. No.: 397,535

[22] Filed: Jul. 12, 1982

[51] Int. Cl.[3] ..... A47B 97/04

[52] U.S. Cl. ..... 248/447; 248/460

[58] Field of Search ..... 248/460, 464, 447, 455, 248/456, 457, 459, 463, 464, 465; 40/152.1

[56] References Cited

U.S. PATENT DOCUMENTS

| | | | |
|---|---|---|---|
| 1,902,011 | 3/1933 | Brewer | 248/464 |
| 2,022,865 | 12/1935 | McAdams | 248/460 |
| 2,592,252 | 4/1952 | Coste | 248/464 |
| 3,562,796 | 10/1968 | Jacobson | 248/460 X |

FOREIGN PATENT DOCUMENTS

| | | | |
|---|---|---|---|
| 20566 | of 1912 | United Kingdom | 248/460 |
| 393866 | 6/1933 | United Kingdom | 248/460 |

*Primary Examiner*—J. Franklin Foss

*Attorney, Agent, or Firm*—James B. Middleton

[57] ABSTRACT

A foldable stand for holding a card or the like for easy viewing. The stand includes a base and a supporting member pivotal with respect to each other. A pivot body carries the pivot pin, and carries a stop pin that extends into the vertex between the base and the supporting member as the members are rotated in opposite directions. The pivot body also carries a trough that is aligned to carry the card or the like when the stop pin is in position to limit the rotation of the base and supporting members.

3 Claims, 8 Drawing Figures

FIG. 1
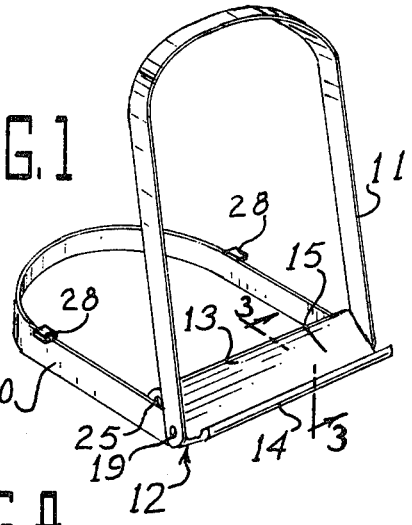
FIG. 2
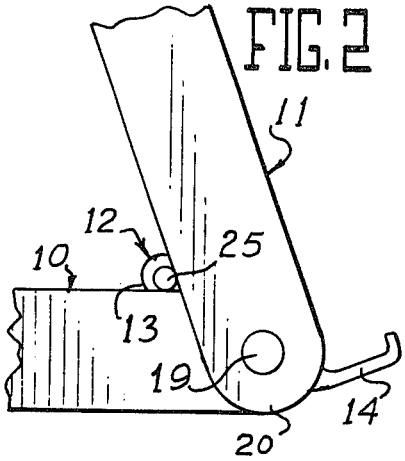
FIG. 8
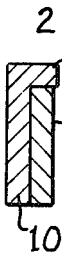
FIG. 3
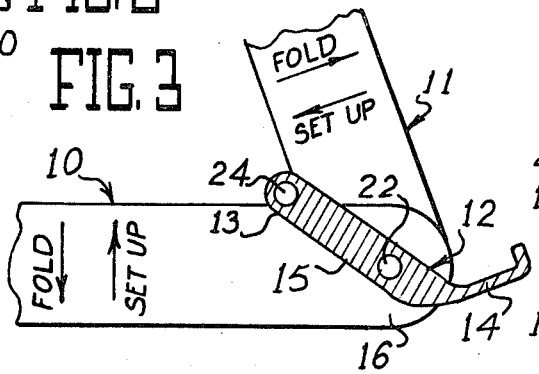
FIG. 4
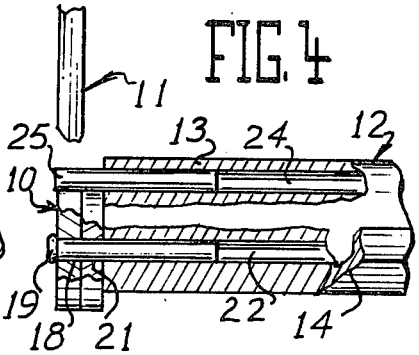
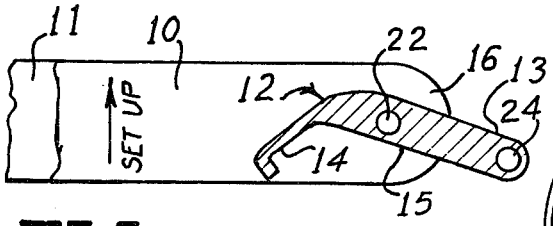
FIG. 5
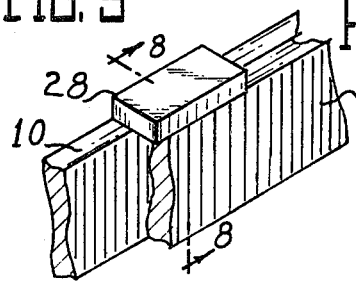
FIG. 7
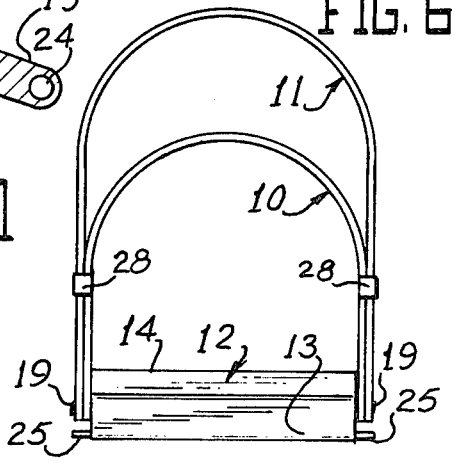
FIG. 6

FOLDABLE STAND

FIELD OF THE INVENTION

This invention relates generally to support stands and the like, and is more particularly concerned with a foldable stand for supporting a card, sheet material or the like for easy viewing.

BACKGROUND OF THE INVENTION

There are many circumstances in which it is desirable to support a card or other sheet-like material in a generally vertical attitude for easy viewing or reading. The prior art includes numerous stands for supporting books, cards, plaques and other materials to allow easy reading, for decorative display and the like. However, prior art stands tend to be made for a special purpose and are either simple wire structures designed to be hidden behind plaque or the like, or are elaborate, perhaps massive, structures designed to be attractive in themselves. While some of the prior art stands have been made to be foldable, foldable stands have not been designed to be easily packed and transported, nor easily set up for use.

SUMMARY OF THE INVENTION

The present invention overcomes the above mentioned and other difficulties with the prior art foldable stands by providing a stand having a base member and a support member rotatable with respect to each other, the base member being nestable within the support member. The trough for holding the bottom edge of a card or the like may be integrally formed with a pivot body, this body also including the locking means to limit rotation of the support member with respect to the base member. The entire structure is preferably formed so that the base member and support member are nested together, and the trough with the pivot body will lie within the outer limits of the base and support members. The base member and support member can be rotated in opposite directions, and one motion will fold the stand and the opposite motion will set up the stand for use.

BRIEF DESCRIPTION OF THE DRAWINGS

These and other features and advantages of the present invention will become apparent from consideration of the following specification when taken in conjunction with the accompanying drawings in which:

FIG. 1 is a perspective view showing a foldable stand made in accordance with the present invention, the stand being shown in its set-up form ready for use;

FIG. 2 is an enlarged, side elevational view of the stand shown in FIG. 1, with portions of the base and support members being broken away;

FIG. 3 is an enlarged cross-sectional view taken substantially along the line 3—3 in FIG. 1;

FIG. 4 is a fragmentary front elevational view, with portions broken away to show the construction;

FIG. 5 is a view similar to FIG. 3 but showing the stand in its folded condition;

FIG. 6 is a plan view showing the entire stand in its folded condition;

FIG. 7 is a fragmentary perspective view showing a stop means useable when folding the stand; and, FIG. 8 is a cross-sectional view taken along the line 8—8 in FIG. 7.

DESCRIPTION OF AN EMBODIMENT OF THE INVENTION

Referring now more particularly to the drawings and to that embodiment of the invention here presented by way of illustration, it will be seen in FIG. 1 that the stand includes a base member 10, and a support member 11 extending upwardly from one end of the base member 10. The support member 11 is angularly related to the base member 10 as will be discussed in more detail hereinafter. At the intersection of the base member 10 and the support member 11, there is the pivot body 12 which includes a trough portion 14 for supporting the lower edge of a card or the like. The pivot body 12 also includes a locking portion 13 and a pivot portion 15 for carrying the pivot pins and locking pins.

As is shown in FIG. 1, the support member 11 will not move further towards the base member 10, but is locked in this position to support a card or the like. However, the support member 11 will easily rotate in the opposite direction, through an angle of over 270°, so the base member 10 can be nested within the support member 11.

Attention is next directed to FIGS. 2, 3 and 4 for a detailed explanation of the construction of the stand shown in FIG. 1. Here it will be seen that the base member 10 and support member 11 are formed of flat stock, generally rectangular in cross-section. While those skilled in the art will realize that other forms of material can be used quite readily, the flat stock will allow extremely easy manufacture by simply cutting appropriate lengths and bending them to the desired shape. With such a procedure, steel or aluminum stock could be used quite easily. It will be readily understood, however, that the entire base member and support member could be molded in plastic or the like.

The pivot body 12 is here shown as formed in a single piece, but with appropriate pins added as necessary. The pivot body 12 could of course be fabricated if desired for small production runs; but, it will be seen that the pivot body 12 is of uniform cross-section throughout its length, so the body could be very easily extruded. The extrusion could be cut to appropriate lengths, pins inserted as needed, and the stand could be assembled.

The base member 10 has rounded ends 16 with appropriate holes 18 to receive the pivot pins 19. Similarly, the lower end of the support member 11 has rounded ends 20 having the appropriate holes 21 to receive the pivot pins 19. Since the base member 10 has its ends 16 inside the ends 20 of the support member 11, and the base member 10 is shorter than the support member 11, it will be understood that the base member 10 can be completely nested within the support member 11. Also, the base member 10 and the support member 11 are made of material having the same width, so the two members will fold into a neat package.

The trough portion 14 of the pivot body 12 extends forwardly, beyond the front edge of the support member 11 so a card or the like can have its lower edge within the trough, and rest against the supporting member 11. The pivot body 12 is held against rotation when the stand is set up so the trough portion 14 cannot rotate; and, the means to prevent rotation of the pivot body 12 is the same as the locking means to lock the position of the supporting member 11 with respect to the base member 10.

The pivot body 12 has a first hole 22 extending through the pivot portion 15, and a second hole 24 that is parallel to the hole 22 and extending through the locking portion 13 of the body 12. The hole 22 receives the pivot pins 19, so the hole 22 is aligned with the hole 18 in the base member 10 and the hole 21 in the support member 11. The centerline of the hole 22 constitutes the pivot axis for the entire structure.

The hole 24 through the locking portion 13 of the body 12 receives the locking pins 25. The locking pins 25 protrude from the body 12 to a sufficient extent that the pins 25 engage the base member 10 and the supporting member 11.

Since the locking portion 13 and the pivot portion 15 are fixed with respect to each other (integrally formed in the embodiment here presented), the pinching of the locking pin 25 in the vertex of the base member 10 and supporting member 11 limits the motion of the base and supporting members, and also fixes the rotational position of the trough portion 14.

From the foregoing description, those skilled in the art will readily see that the stand can be molded, as by injection molding, with all pieces arranged to be snapped together. Rather than the holes 22 and 24 for receiving pins 19 and 25, the pins 19 and 25 can be integrally molded with the pivot body 12. The pivot pin 19 can be formed with a slightly enlarged head that will allow the members 10 and 11 to be snapped onto the pin. Thus, the description herein is intended to cover such an arrangement as well as the construction illustrated.

In preparing a specific design for a foldable stand made in accordance with the present invention, the particular combination of dimensions must be considered. Looking especially at FIG. 3 of the drawings it will be realized that, with a given distance between the centerlines of the holes 22 and 24, the height of the base member 10 and the width of the support member 11 can be varied, and the angle at which the support member is locked will change. Conversely, with a given width of material for the members 10 and 11, variation in the distance between the centerlines of the holes 22 and 24 will vary the locking angle of the member 11 with respect to the member 10. Once the particular materials are selected, the precise design will be quite easy to calculate for the selected angle. Furthermore, it will be understood that, with the arrangement shown in FIG. 3 of the drawings, the member 10 and/or the member 11 can be provided with notches to allow the support member 11 to be moved in a counterclockwise direction somewhat further; or, protuberances may be provided on the material to bear against the locking pin 25 and cause the support member 11 to be in a more nearly upright position, or to form an angle closer to 90° with respect to the base member 10.

While the members 10 and 11 cannot move towards each other as shown in FIG. 3 of the drawings, it will be seen that the members can be rotated in the opposite directions and there is no obstruction to their movement. This is to say the member 11 can be rotated in a clockwise direction and the member 10 can be rotated in a counter-clockwise direction as viewed in FIG. 3. With this motion, it will be seen that the members 10 and 11 are moving away from the locking pin 25. As a result, the members 10 and 11 can be rotated until the two members are parallel, or nested together as is shown in FIGS. 5 and 6 of the drawings. Since the pin 25 protrudes beyond the confines of the members 10 and 11, the pivot body 12 can be oriented as shown in FIG. 5 in order to provide a very flat, folded stand for storage. Though other designs may be used when desired, it is preferred that the pivot body 12 be arranged so that, when the stand is folded as shown in FIG. 5, the pivot body 12 is within the confines of the upper and lower edges of the folded members 10 and 11.

It will therefore be understood that the present invention provides a foldable stand that is extremely easy to use. If desired, appropriate legends may be applied to the stand as shown in FIG. 3, using arrows to indicate the appropriate direction to fold the stand and to set up the stand. From the foregoing description, it will be understood that the members 10 and 11 are always rotated in one direction to set up the stand, and always rotated in the opposite direction to fold the stand. When the stand is being set up, one would simply rotate the two members 10 and 11 in the direction of the arrows until the members stopped. At that point, the stand is ready to use. When the stand is to be folded, one would simply move the members 10 and 11 in the direction shown by the arrows; and, when the members 10 and 11 are nested, the stand is folded and ready for storage.

As described above, it will be understood that the members 10 and 11 would continue to pivot in the folding direction until the locking pin 25 is again engaged in the vertex. Such a motion, however, would arrange the stand backwards, with the support 11 as the base and the base 10 as the support. To prevent this possibility, a folding stop can be easily provided.

In FIG. 1 of the drawings, a stop 28 is shown fixed to the base 10. The stop 28 is located at the upper edge of the base 10, and is preferably placed on the base where the base and support will be parallel when the stand is folded.

Looking at FIGS. 7 and 8, which show the stop 28 in more detail, it will be seen that the stop 28 comprises simply a block fixed to the edge of the base 10. Since it is desirable to allow the base 10 and support 11 to overlap fully when the stand is folded, the stop 28 is at the edge of the base 10. It will be obvious, however, that the stop 28 could be placed inwardly of the base 10 and the support 11 appropriately notched to receive the stop.

In any event, the stop 28 may be bent from the material of the base 10 if the base is made from metal, or the stop 28 can be integrally molded with the base 10 if the base 10 is molded of plastic or the like.

The preferred placement of the stop 28 is illustrated in FIG. 6. The longest lever arm available is desired, so the stop 28 is placed where the base 10 and support 11 are parallel, just before the two members diverge. While one may choose to place the stop 28 further around the curve of the base 10, the stop 28 would have to be longer to engage the support 11. This would be an operable arrangement, but mechanically less desirable.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as defined in the appended claims.

I claim:

1. A foldable stand including a base member, a supporting member pivotally carried at one end of said base member, and a trough member disposed at the lower end of said supporting member, a pivot member including a pivot pin for pivotally connecting said base member and said supporting member, a locking member carried by said pivot member and pivotal therewith, a locking pin extending into the vertex between said base member and said supporting member for limiting rotation of said supporting member with respect to said base member, said locking pin being carried by said locking member, said trough member being carried by said pivot member and pivotal therewith, said trough member being disposed to receive a card or the like to be supported by said supporting member when said locking pin is in the vertex between said base member and said supporting member, said trough member, said pivot member and said locking member being formed integrally into a pivot body, said pivot body having said pivot pin extending therefrom along a first centerline, and having said locking pin extending therefrom along a second centerline, said first centerline being parallel to said second centerline, said base member being receivable within the confines of said supporting member such that the two are nested together, said trough member being disposable within said base member by rotation of said pivot body, said base member having a height equal to a first dimension, said supporting member having a width equal to said first dimension so that said base member and said supporting member nest together with a maximum thickness equal to said first dimension, said pivot body being disposable with said trough member within the confines of said base member such that said pivot body is within said maximum thickness, and further including stop means carried by said base member for limiting rotation of said support member with respect to said base member when said base member and said support member are nested.

2. A foldable stand as claimed in claim 1, said pivot body defining a first hole therethrough for receiving said pivot pin, and defining a second hole therethrough for receiving said locking pin, said second hole being parallel to said first hole.

3. A foldable stand including a base member having spaced apart ends, a supporting member having spaced apart ends, a pivot body received between said spaced apart ends of said supporting member, said pivot body having a uniform cross-section throughout its length and including a pivot member portion, a pair of pivot pins extending longitudinally from said pivot member, said spaced apart ends of said base member and said spaced apart ends of said supporting member receiving said pair of pivot pins therethrough for pivotally mounting said supporting member to said base member, said pivot body including a trough member extending along one side thereof for receiving the lower edge of a card or the like, said pivot body further defining a locking member carried along another side thereof opposite and parallel to said trough member, a pair of locking pins extending longitudinally from said locking member and receivable in the vertex between said base member and said supporting member, the arrangement being such that said pair of locking pins are held in said vertex and prevent rotation of said pivot body about said pivot pins in order to stabilize said trough member, said supporting member and said base member being rotatable with respect to each other about said pivot pins to release said locking pins and allow rotation of said pivot body about said pivot pins.

* * * * *